US011148691B2

(12) United States Patent
Gao et al.

(10) Patent No.: US 11,148,691 B2
(45) Date of Patent: Oct. 19, 2021

(54) SWITCH CONTROL METHOD, DEVICE AND CONTROLLER

(71) Applicant: Traffic Control Technology Co., Ltd., Beijing (CN)

(72) Inventors: Chunhai Gao, Beijing (CN); Bo Liu, Beijing (CN)

(73) Assignee: Traffic Control Technology Co., Ltd, Beijing (CN)

( * ) Notice: Subject to any disclaimer, the term of this patent is extended or adjusted under 35 U.S.C. 154(b) by 648 days.

(21) Appl. No.: 16/077,796

(22) PCT Filed: Nov. 16, 2016

(86) PCT No.: PCT/CN2016/106079
§ 371 (c)(1),
(2) Date: Aug. 14, 2018

(87) PCT Pub. No.: WO2018/040295
PCT Pub. Date: Mar. 8, 2018

(65) Prior Publication Data

US 2020/0114940 A1 Apr. 16, 2020

(30) Foreign Application Priority Data

Aug. 31, 2016 (CN) ..... 201610794844.7

(51) Int. Cl.
*B61L 11/08* (2006.01)
*B61L 5/06* (2006.01)
(Continued)

(52) U.S. Cl.
CPC ..... *B61L 11/08* (2013.01); *B61L 5/06* (2013.01); *B61L 27/0005* (2013.01); *B61L 27/0038* (2013.01); *B61L 15/0027* (2013.01)

(58) Field of Classification Search
CPC ..... B61L 5/06; B61L 11/08; B61L 15/0027; B61L 19/06; B61L 27/0005; B61L 27/0038; B60L 15/40
(Continued)

(56) References Cited

U.S. PATENT DOCUMENTS 5,504,405 A 4/1996 Hager
7,282,816 B2 10/2007 Ridgeway
(Continued)

FOREIGN PATENT DOCUMENTS

CN 101758839 A 6/2010
CN 102935853 A 2/2013
(Continued)

OTHER PUBLICATIONS

The First Official Action and search report dated Sep. 4, 2017 for Chinese application No. 201610794844.7, 9 pages.
(Continued)

*Primary Examiner* — Zachary L Kuhfuss
(74) *Attorney, Agent, or Firm* — Law Offices of Liaoteng Wang

(57) ABSTRACT

The invention discloses a switch control method, device and controller. The method includes the following steps: an on-board device acquiring a switch state and determining a target resource permission to be requested according to the switch state; the on-board device sending a first resource request including the target resource permission to a switch; obtaining a resource state of the switch, and assigning a resource permission on the switch according to the resource state and the target resource permission; and controlling the switch according to a result of the resource permission assignment.

7 Claims, 10 Drawing Sheets

(51) Int. Cl.
*B61L 27/00* (2006.01)
*B61L 15/00* (2006.01)

(58) Field of Classification Search
USPC ..... 701/19
See application file for complete search history.

(56) References Cited

U.S. PATENT DOCUMENTS

| | | | | |
|---|---|---|---|---|
| 2012/0323411 | A1* | 12/2012 | Whitwam | B61L 11/08 701/19 |
| 2014/0149594 | A1 | 5/2014 | Amorim | |
| 2016/0046307 | A1* | 2/2016 | Miyajima | B61L 27/0005 701/19 |
| 2018/0281831 | A1* | 10/2018 | Adomeit | B61L 11/08 |

FOREIGN PATENT DOCUMENTS

| | | | |
|---|---|---|---|
| CN | 202827640 | U | 3/2013 |
| CN | 103991465 | A | 8/2014 |
| CN | 104002834 | A | 8/2014 |
| CN | 104228883 | A | 12/2014 |
| CN | 104614748 | A | 5/2015 |
| CN | 105539511 | A | 5/2016 |
| DE | 19526159 | C1 | 9/1996 |
| EP | 0430192 | A2 | 6/1991 |
| EP | 2607199 | A1 | 6/2013 |
| GB | 2152259 | A | 7/1985 |

OTHER PUBLICATIONS

PCT International Search Report for PCT/CN2016/106079, dated Jun. 14, 2017, 12 pages.

Wang, Guojun et al. Research on Turnout Control Scheme and Installation Mode for Tramway Railway Standard Design Jan. 31, 2014(Jan. 31, 2014) No. 1 vol. 58 ISSN:1004-295 the whole document.

Li, Qiang A Study on the Switch Control System of the Main Track of Modern Trams Automatic Control System & Equipment Feb. 28, 2015(Feb. 28, 2015) No. 2 vol. 37 ISSN: 1000-3886 the whole document.

The extended European search report dated Aug. 27, 2019 for European Application No. 16914857.4, 7 pages.

* cited by examiner

SWITCH CONTROL METHOD, DEVICE AND CONTROLLER

CROSS-REFERENCE TO RELATED APPLICATION

This application is based upon and claims priority to Chinese Patent Application No. 2016107948447, filed on Aug. 31, 2016, the content of which is incorporated herein by reference in its entirety.

TECHNICAL FIELD

The embodiments of the present invention relate to the technical field of computers, and particularly to a switch control method, device and controller.

BACKGROUND

Typically, an interlocking system is used in the traditional rail transit technology to perform logic computation on the operation commands of station operators and information represented on the spot, thus allowing centralized control and supervision on switches, routes and signals. A route is a combination guaranteeing a set of line resources during train running, these line resources being in certain association and restriction relationships with one another, and route control is substantially management and maintenance on the combination of the line resources. In addition, a signal machine is disposed beside a rail to guarantee route safety and accomplish interlocking tasks, and achieve safety protection for a train line.

However, the arrangement of the interlocking system and the signal machine on the ground is required in the prior art to achieve safety protection for lines, whereas the problems of complicated interlocking logic, high system complexity, and high cost and complex installation and maintenance of such ground equipment as the interlocking system are present; moreover, the line resources in one route can only be used by one train, leading to low utilization efficiency of line resources for trains.

During the implementation of the embodiments of the present invention, the inventor found in the prior art these problems of complicated interlocking logic, high system complexity, and high cost and complex installation and maintenance of such ground equipment as the interlocking system, and also low utilization efficiency of line resources for trains due to that the line resources in one route can only be used by one train.

SUMMARY

In a first aspect, the embodiments of the present invention provide a switch control method, which includes:

an on-board device acquiring a switch state and determining a target resource permission to be requested according to the switch state;

the on-board device sending a first resource request including the target resource permission to a switch;

acquiring a resource state of the switch, and assigning a resource permission on the switch according to the resource state and the target resource permission; and controlling the switch according to a result of resource permission assignment.

Preferably, the determining of the target resource permission to be requested according to the switch state further includes:

determining the target resource permission to be requested as a monopolized state permission if the switch state needs to be changed to accomplish train running; and determining the target resource permission to be requested as a shared state permission if train running can be accomplished without changing the switch state;

wherein the switch state includes a normal position and a reverse position, and the target resource permission includes the monopolized state permission and the shared state permission.

Preferably, the assigning of the resource permission on the switch according to the resource state and the target resource permission further includes:

assigning the monopolized state permission on the switch corresponding to the first resource request to the on-board device if the target resource permission is the monopolized state permission and the switch is in a released state;

assigning the shared state permission on the switch corresponding to the first resource request to the on-board device if the target resource permission is the shared state permission and the switch is in the released state;

failing to assign the resource of the switch corresponding to the first resource request to the on-board device if the target resource permission is the monopolized state permission and the switch is in a monopolized state;

failing to assign the resource of the switch corresponding to the first resource request to the on-board device if the target resource permission is the shared state permission and the switch is in the monopolized state;

failing to assign the resource of the switch corresponding to the first resource request to the on-board device if the target resource permission is the monopolized state permission and the switch is in a shared state;

assigning the shared state permission on the switch corresponding to the first resource request to the on-board device if the target resource permission is the shared state permission and the switch is in the shared state;

wherein the resource state of the switch includes the monopolized state, the shared state and the released state.

Preferably, the controlling on the switch according to the result of the resource permission assignment further includes:

moving the switch if the resource permission obtained by the on-board device is the monopolized state permission on the switch; and the on-board device sending a resource release request to the switch so as to control the switch to be shifted into the released state after a train passes through the switch and moves away from a switch section.

Preferably, the controlling on the switch according to the result of the resource permission assignment further includes:

moving the switch if the resource permission obtained by the on-board device is the monopolized state permission on the switch, and the on-board device sending a resource shifting request to the switch so as to control the switch to be shifted into the released state from the monopolized state after a train passes through the switch and moves away from the switch section.

Preferably, the method further includes:

determining the resource state of the switch if the first resource request for the switch sent by the on-board device and a second resource request for the switch sent by a control center are received within a predetermined period;

changing the resource state of the switch into the released state if finding, by determination, that a resource permission corresponding to the second resource request is the monopolized state permission and the resource state of the switch is the monopolized state or the shared state; and assigning the resource permission corresponding to the second resource request to the control center.

Preferably, the method further includes:

receiving a query request sent by the on-board device or the control center, and sending corresponding data information to the on-board device or the control center according to the query request;

sending updated data information to the control center and on-board devices in a train communication list if finding, by determination, that the data information in a switch controller is updated; and interrupting connection with the on-board device and deleting the on-board device from the train communication list if no query request is received from the on-board device within predetermined time.

In a second aspect, the embodiments of the present invention also provide a switch control device, which includes:

a permission requesting module for acquiring a switch state, and determining a target resource permission to be requested according to the switch state;

a request sending module for sending a first resource request including the target resource permission to a switch;

a permission assigning module for acquiring a resource state of the switch, and assigning a resource permission on the switch according to the resource state and the target resource permission;

and a switch controlling module for controlling the switch according to a result of resource permission assignment.

Preferably, the permission requesting module further includes:

a monopolized state requesting unit for determining the target resource permission to be requested as a monopolized state permission if the switch state needs to be changed to accomplish train running; and a shared state requesting unit for determining the target resource permission to be requested as a shared state permission if train running can be accomplished without changing the switch state;

wherein the switch state includes a normal position and a reverse position, and the target resource permission includes the monopolized state permission and the shared state permission.

In a third aspect, the embodiments of the present invention also provide a switch controller, which includes the switch control device as described above;

the switch controller is connected to an on-board device, a control center, a switch machine and an axle counting system, respectively; and the switch controller is arranged beside a rail or in a station.

BRIEF DESCRIPTION OF THE DRAWINGS

In order to illustrate the embodiments of the present invention or the technical solutions in the prior art more clearly, accompanying drawings for use in describing the embodiments or the prior art will be briefly introduced below. It is apparent that the accompanying drawings in the following descriptions are merely some embodiments of the present invention, and for a person skilled in the art, other drawings may also be obtained according to these drawings without creative work.

DETAILED DESCRIPTION OF THE PREFERRED EMBODIMENTS

The specific implementations of the present invention will be further described below in conjunction with the accompanying drawings. The following embodiments are merely intended for illustrating the technical solutions of the present invention more clearly, rather than limiting the protection scope of the present invention.

Figure 1:
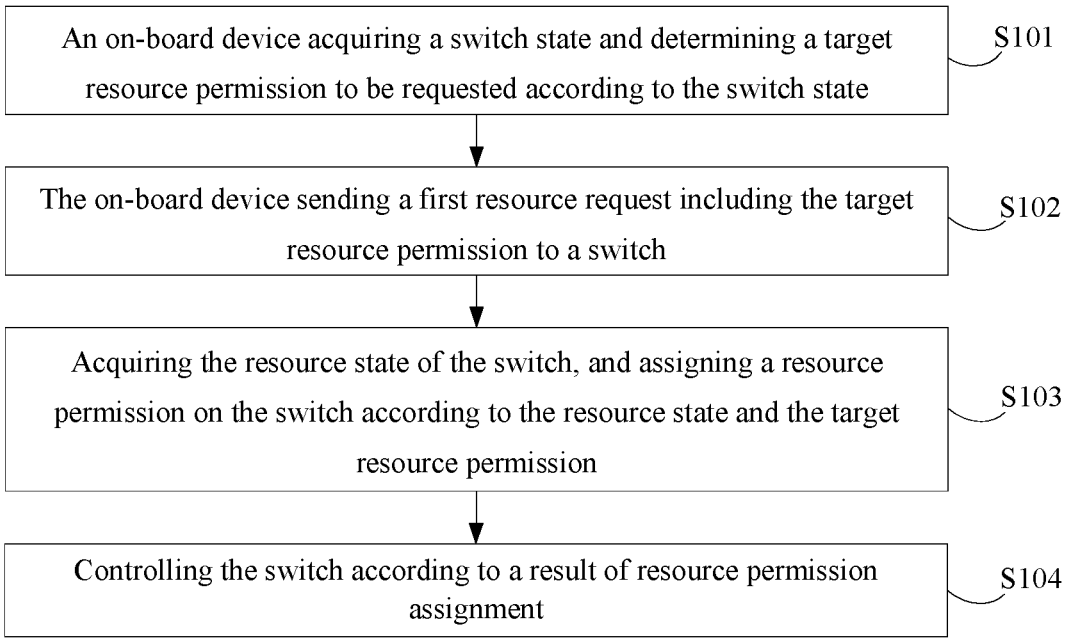
FIG. 1 is a schematic flowchart of a switch control method provided by an embodiment of the present invention.

FIG. 1 shows the schematic flowchart of the switch control method provided by this present embodiment, including:

S101, an on-board device acquires a switch state and determines permission of the target resources to be requested based on the switch state;

wherein the on-board device determines whether the switch needs to be moved by inquiring the switch state; if the switch needs to be moved, it is considered that a monopolized state permission on the switch needs to be requested; otherwise, it is considered that a shared state permission on the switch needs to be requested.

Specifically, if the switch state needs to be changed to meet the train running requirement, permission of the target resource to be requested is the monopolized state permission; if train running can be accomplished without changing the switch state, permission of the target resource to be requested is the shared state permission; wherein the switch state includes a normal position and a reverse position, and the target resource permission includes the monopolized state permission and the shared state permission.

Under the control of the normal position and the reverse position of the switch, a train may run in different directions.

Further, the shared states of the switch includes a shared normal position state and a shared reverse position state.

S102, the on-board device sends a first resource request including the target resource permission to a switch;

wherein the first resource request is a request for a switch resource permission sent by the on-board device.

The target resource permission is a resource permission on a switch pre-requested by the on-board device, and the state of the resource includes a monopolized state and a shared state.

S103, the resource state of the switch is obtained, and a resource permission on the switch is assigned according to the resource state and the target resource permission;

wherein the resource state of the switch is use condition of the current resource of the switch, for example, whether there is a train already assigned with the resource state of the switch, a list of trains already assigned with the resource state and specific types of the resource states already assigned to other trains;

wherein the assigning of the resource permission on the switch includes assigning the resource state of the switch to the train corresponding to the on-board device according to a preset rule.

Specifically, the monopolized state permission on the switch corresponding to the first resource request is assigned to the on-board device if the target resource permission is the monopolized state permission and the switch is in a released state;

the shared state permission on the switch corresponding to the first resource request is assigned to the on-board device if the target resource permission is the shared state permission and the switch is in the released state;

the resource of the switch corresponding to the first resource request cannot be assigned to the on-board device if the target resource permission is the monopolized state permission and the switch is in the monopolized state;

the resource of the switch corresponding to the first resource request cannot be assigned to the on-board device if the target resource permission is the shared state permission and the switch is in the monopolized state;

the resource of the switch corresponding to the first resource request cannot be assigned to the on-board device if the target resource permission is the monopolized state permission and the switch is in the shared state;

the shared state permission on the switch corresponding to the first resource request is assigned to the on-board device if the target resource permission is the shared state permission and the switch is in the shared state;

wherein the resource state of the switch includes the monopolized state, the shared state and the released state.

S104, the switch is controlled according to the result of the resource permission assignment;

wherein the controlling on the switch specifically includes controlling the time and the position of change of the switch.

Specifically, the on-board device of the train controls the switch according to the result of the resource permission assignment.

It is more convenient for handling the complicated conditions during the actual running process of the train and improves the running efficiency of the train through controlling the switch and dominating by the train.

In another embodiment, a switch may control the switch state according to the result of the resource permission assignment, and may allow a moving operation on the switch.

Further, that controlling the switch according to the result of the resource permission assignment further includes:

moving the switch if the resource permission obtained by the on-board device is the monopolized state permission on the switch; and the on-board device sending a resource release request to the switch so as to control the switch to be shifted into the released state after a train passes through the switch and moves away from a switch section.

In another embodiment, that controlling the switch according to the result of the resource permission assignment further includes:

moving the switch if the resource permission obtained by the on-board device is the monopolized state permission on the switch, and the on-board device sending a resource shifting request to the switch so as to control the switch to be shifted into the released state from the monopolized state after a train passes through the switch and moves away from the switch section.

A "one-lock-for-one-train" control mode is used in this embodiment, i.e., the resource permission (lock) on each switch can only be assigned to one train at the same moment. Therefore, after a preceding train passes through the switch, release of the resource permission is required so that a later train can achieve the resource permission on the switch.

Specifically, a switch controller receives a first resource request for a switch sent by an on-board device, acquires the resource state of the switch, then assigns the resource permission on the switch according to the resource state and the target resource permission, and controls the switch according to the result of the resource permission assignment.

Figure 2:
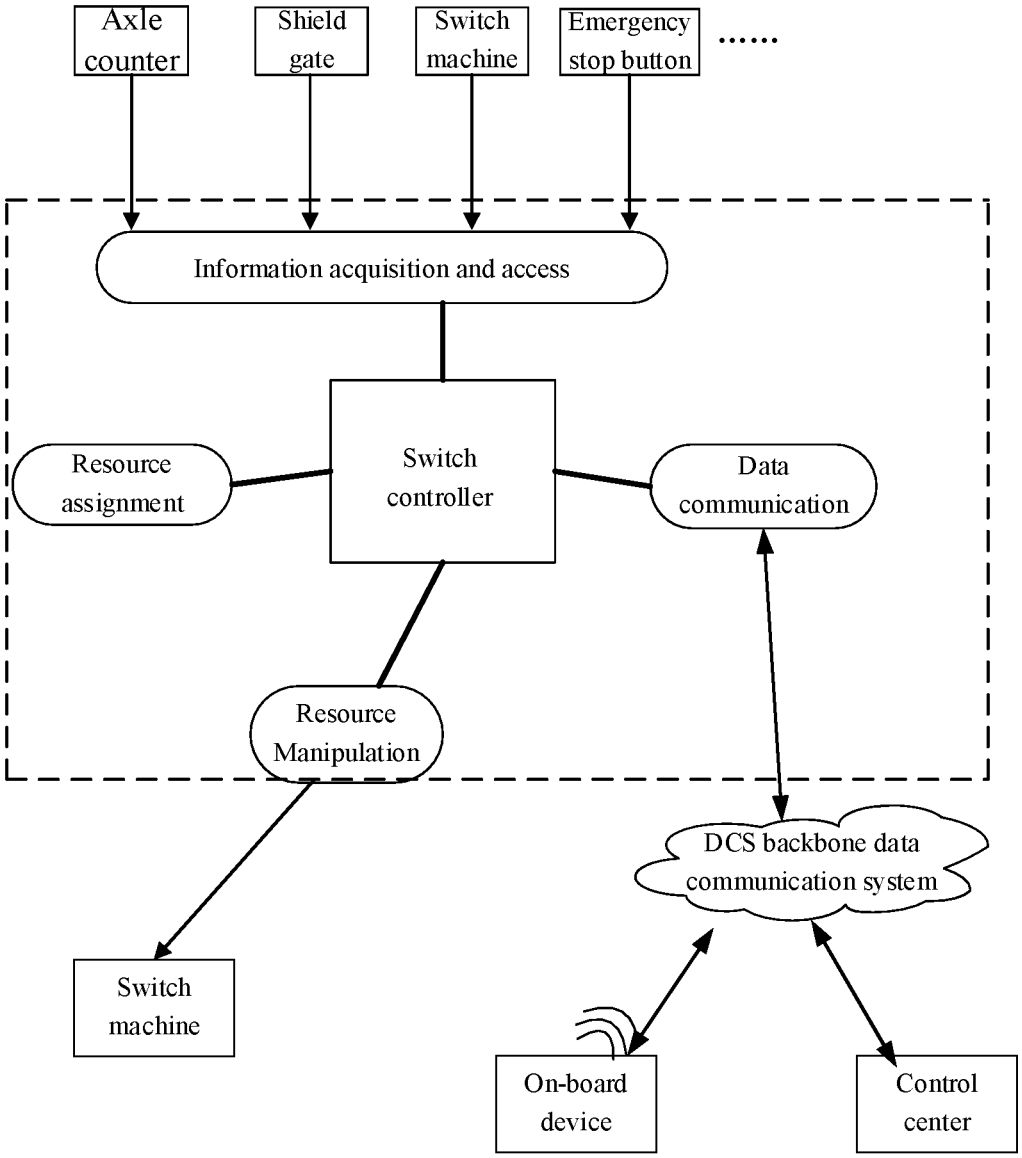
FIG. 2 is a functional schematic diagram of a switch controller provided by another embodiment of the present invention.

In this case, the functions of the switch controller may be divided into information acquisition and access, resource assignment, data communication and resource manipulation, as shown in FIG. 2.

In this case, the information acquisition and access function specifically includes that the switch controller acquires the state information (e.g., occupancy states of axle counting sections, switch state and the like) of line resources in real time through interaction with other equipment (a switch machine, an axle counting system and the like). Information is stored in the form of a list, and updated in real time. Wherein the information acquired includes occupancy/idle state information of the axle counting sections, the switch state information, emergency stop button information, the state information of a flood gate, and ID and IP address information of a train.

The resource assignment function specifically includes that a permission on line resources must be requested by a train first before using the line resources (a switch and related sections), and the switch controller assigns the line resources for the train, and provides different resource permission levels, and the train can use switch resources only after obtaining the corresponding permissions.

The data communication function specifically includes accessing a DCS backbone network and data interaction of the switch controller with other on-board devices and a control center.

The resource manipulation function specifically includes: controlling a switch by a train, in which the train is required to request for a permission on a switch section first and then sends a command of moving the switch to the switch controller after obtaining the corresponding permission. The switch controller sends a switch moving instruction to the switch machine after receiving the command; controlling a switch by the control center, in which the control center is required to request for a permission on a switch section first and then sends a command of moving the switch to the switch controller after obtaining the related permission.

The switch controller differs from the existing interlocking equipment in that determination of interlocking relationship of switch control is not carried out. Some existing devices may be used as the switch controller, but are not connected with the interlocking equipment. The switch controller is a resource control management equipment for assigning, saving and updating line resources.

The information acquisition and access function permits interaction, saving and management of line resources. Storage and updating of resources are achieved in the form of a maintenance list, and there is no need to save an electronic map to allow for simplification of the logical structure of the rail-side equipment, namely the switch controller; Resource assignment permits management of line resources; The shared state or shared lock of a switch provides moving block in a switch section; By means of the data communication, the switch controller is connected to the on-board devices and the control center to receive resource requests or release instructions from the on-board devices and the control center, and the switch controller feeds back the state information of line resources after receiving a query command from a train or the control center, which is a passive response equipment; and control a switch by the resource manipulation.

The traditional interlocking technique is not used in this embodiment, and such ground equipment as interlocking and signal machines thus do not need to be disposed on the ground, leading to simplification of the control logic and reduction of the equipment cost and the maintenance cost; at the same time, depending on the resource request from the on-board device, the assignment and control of the resource permission are achieved by determining the resource state of the switch, before a train arrives at the required switch and section resources, the resources are requested and assigned, thus allowing safety protection for the train and increasing the utilization rate of line resources.

Further, on the basis of the above method embodiment, the method further includes:

S105, the resource state of the switch is determined if the first resource request for the switch sent by the on-board device and a second resource request for the switch sent by the control center are received within a predetermined period.

S106, the resource state of the switch is changed into the released state if it is found, by determination, that a resource permission corresponding to the second resource request is the monopolized state permission and the resource state of the switch is the monopolized state or the shared state.

S107, the resource permission corresponding to the second resource request is assigned to the control center.

Specifically, when the switch controller receives lock adding operations from a train and the control center, in the case of the same period, a lock operating command from the control center is executed by the switch controller according to operation object information (the train or the control center); and in the case of different periods, the operating command received first is executed.

When the switch controller receives the lock adding operations from two trains, in the case of the same period, random assignment is carried out; and in the case of different periods, the operating command received first is executed.

When the switch controller receives the lock adding operations from a train and the control center in the same period, the lock operating command from the control center is executed by the switch controller according to operation object information (the train or the control center).

In this case, the control center has a permission on deleting other user resource locks.

By adopting the permission assignment manner of giving priority to the control center, the safety of running of a train can be ensured.

Further, on the basis of the above method embodiments, the method further includes:

S108, a query request sent by the on-board device or the control center is received, and corresponding data information is sent to the on-board device or the control center according to the query request;

S109, updated data information is sent to the control center and on-board devices in a train communication list if it is found, by determination, that the data information in the switch controller is updated; and S110, the connection with the on-board device is interrupted and the on-board device is deleted from the train communication list if no query request is received from the on-board device within predetermined time.

Figure 3:
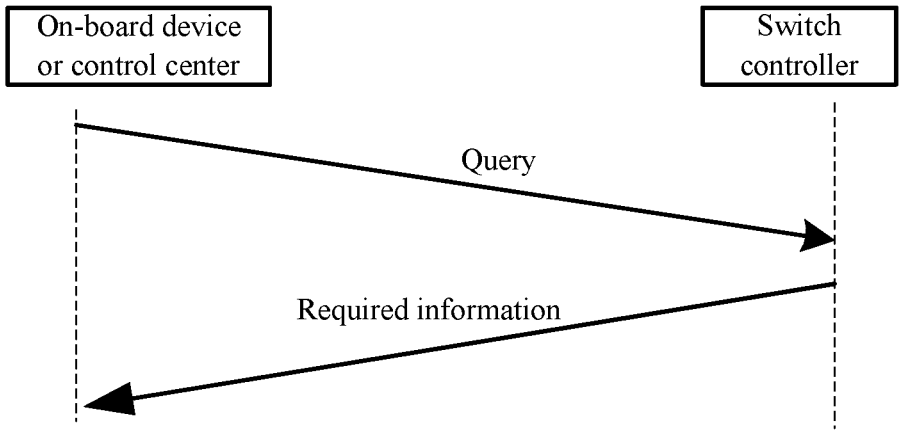
FIG. 3 is a schematic diagram of data communication of a switch controller provided by another embodiment of the present invention.

Specifically, a data communication mode of the switch controller with the on-board device or the control center is as shown in FIG. 3: the switch controller replies the on-board device or the control center with the data information after receiving the query request from the on-board device or the control center.

If the switch controller receives no query information from the on-board device or the control center, it still replies trains in a communication train list and the control center with the updated data information to ensure that on-board devices or the control center can obtain the current data information in time.

If the switch controller receives no query information from a certain train throughout a period of time, it interrupts the connection with this train, and deletes the ID and IP address of this train from the train communication list in order not to send the data information thereto, thereby saving resources.

To prevent from operating one resource simultaneously by a plurality of users (trains or the control center) on one resource, a resource permission control method is introduced, in which the resources include switch sections.

Operations that can be carried out by users include query, addition or deletion of resource permissions.

Wherein, the monopolized state permission is intended for an operation of data modification (moving a switch). One resource can only have one monopolized state permission. When a switch resource is locked with the monopolized state permission, the train/control center holding the monopolized state permission may enable moving of the switch that cannot be achieved by other trains/control center.

If the monopolized state permission is provided on a resource, the shared state permission cannot be added to the resource.

The shared state permission is intended for an operation of no data modification (a train passes through a switch section). One resource may have a plurality of shared state permissions. After a switch is locked by a train with the shared state permission, the train can pass the switch. If the shared state permission is provided on a resource, the monopolized state permission cannot be added to the resource, and the switch cannot be moved.

A shared state permission list and monopolized state permission information are maintained for a section or switch. By taking the switch as an example, a resource permission storage mode is as shown in the following table:

| Number of switches | | | |
|---|---|---|---|
| Switch resource information | Switch ID | | |
| | Switch state (Normal position/Reverse position) | | |
| | Monopolized state permission | Monopolized state permission holder type (train or control center) | |
| | | The switch state required by a monopolized state permission locking section (normal position/reverse position) | |
| | | Monopolized state permission holder ID | |
| | Shared state permission | Number of shared state permissions | |
| | | Shared state permission1 | The switch state required by a shared state permission locking section (normal position/reverse position) |
| | | | Shared state permission holder type (train or control center) |
| | | | Shared state permission holder ID |
| | | Shared state permission 2 | The switch state required by a shared state permission locking section (normal position/reverse position) |
| | | | Shared state permission holder type (train or control center) |
| | | | Shared state permission holder ID |

Permissions of users (train or control center):

| User | Permission | | |
|---|---|---|---|
| | Adding/Canceling resource permission of the user | Canceling the monopolized/shared state permission of other user | Query of data |
| Train | Yes | No | Yes |
| Control center | No | Yes | Yes |

Specifically, resource assignment may also be achieved by changing the resource states. There are three states of line resources, i.e., a monopolized state, a shared state and a released state.

In the monopolized state, the line resources are only available for one train.

In the shared state, the line resources are possibly available for a plurality of trains.

In the released state, the line resources are not used by any train.

Specifically, when a section is in the shared state at present, other trains can request for the shared state at the same position.

When a section is in the monopolized state at present, other trains are not allowed to request for monopolizing and sharing.

A switch can only be moved in the monopolized state.

Changing from the monopolized state to the shared state is allowed on condition that the current monopolizing train requests for changing; in case of a switch section, exact switch moving is required.

Changing from the shared state to the monopolized state is allowed on condition that only one train is in the shared state at present.

Changing from the monopolized state to the released state only requires release by the current monopolizing train.

Changing from the shared state to the released state requires release by all the sharing trains.

Specifically, the on-board device firstly discovers a resource ahead, and can request, use and release the resource only after determining an idle/shared resource state. The switch controller assigns the switch resource state according to an instruction from a train and the resource state.

The monopolized resources can only be assigned to one train, while the shared resources can be assigned to a plurality of trains. After a train requests for a monopolizing permission on a switch or section, other trains are prohibited from controlling and passing the switch and the section.

When a plurality of rains request for the same line resource in the release state, the switch controller assigns the line resource according to a requesting timing sequence.

The control center has priority to requesting for resources. When the control center and a train simultaneously request for the same line resource in the released state, the switch controller assigns the line resource to the control center.

A resource state list is maintained for a section or switch. Using the switch as an example, a storage mode is as shown in the following table:

| Number of switches | | |
|---|---|---|
| Switch resource information | Switch ID | |
| | Switch state (Normal position/Reverse position/Four-throw) | |
| | Switch resource state | Resource state (monopolized/shared/released) |
| | | Resource holder type (train or control) center) |
| | | Number of resource holders |
| | | Resource holder ID |
| | | Required switch state (normal position, reverse position) |

Figure 4:
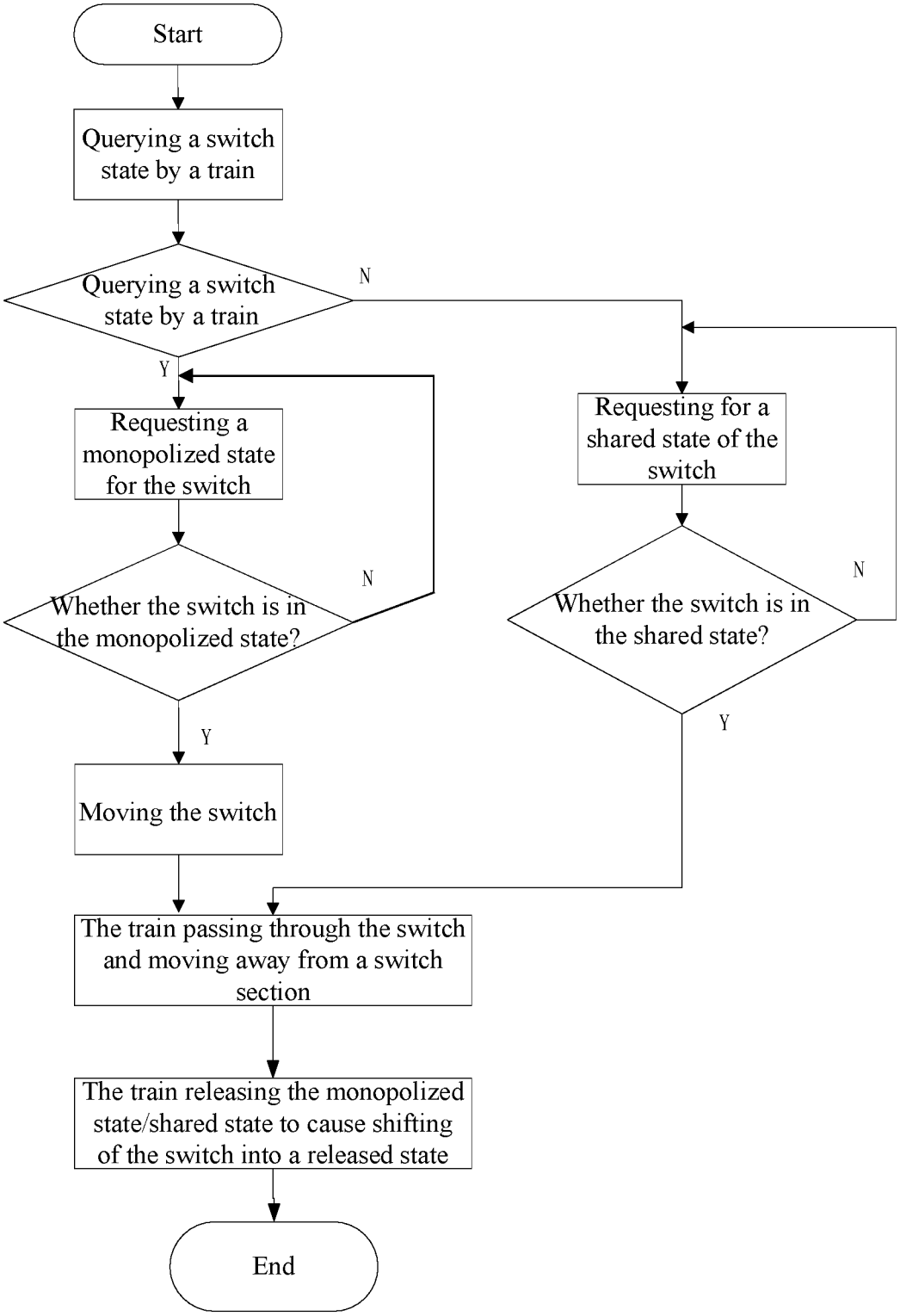
FIG. 4 is a schematic flowchart of switch resources assignment provided by another embodiment of the present invention.

The assignment flow of a switch resource is as shown in FIG. 4.

Figure 5:
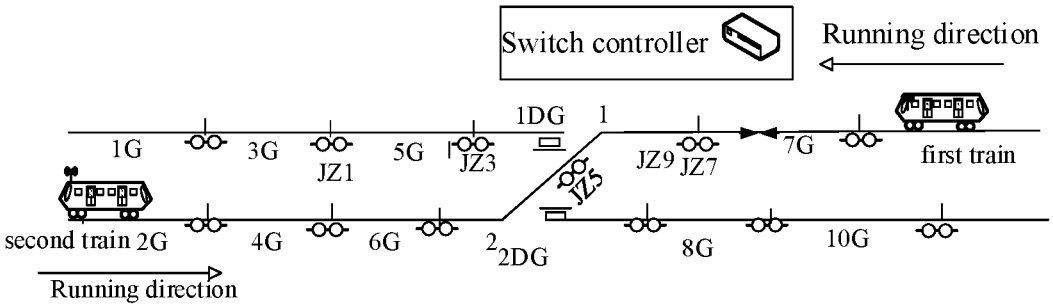
FIG. 5 is a schematic diagram of requesting switch resources by two trains provided by another embodiment of the present invention.

For example, when two trains request for a switch resource, i.e., as shown in FIG. 5, train 1 requires to return and train 2 requires to pass; and train 1 requests for the monopolized state of the switch and train 2 requests for the shared state of the switch. The switch controller assigns the switch resource according to the time sequence of the request information. If train 1 is earlier than train 2 in requesting, the switch controller assigns the monopolized state to train 1, and train 2 has to enter protection section 6G. Train 1 enters a switch section after causing moving of the switch into the reverse position. Train 1 does not release the monopolized state permission on the switch.

Figure 6:
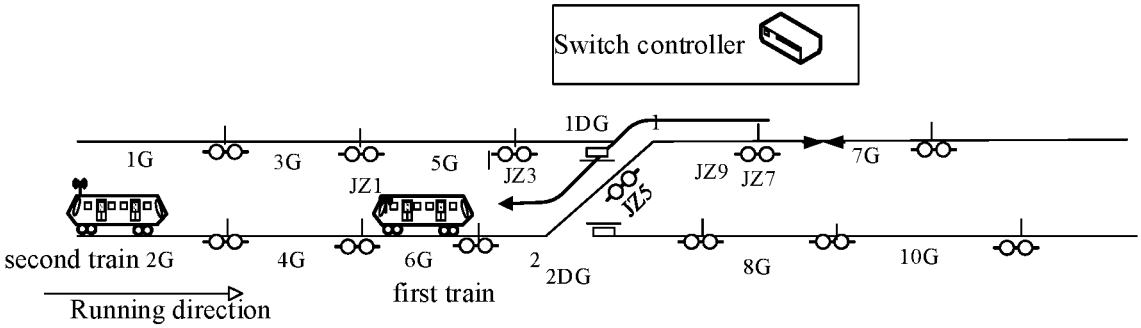
FIG. 6 is a schematic diagram of requesting switch resources by two trains provided by another embodiment of the present invention.

As shown in FIG. 6, after train 1 enters protection section 6G, the switch is moved to the normal position and the monopolized state of the switch is changed into the shared state. In this case, train 2 may also obtain the shared state permission on the switch by requesting.

Figure 7:
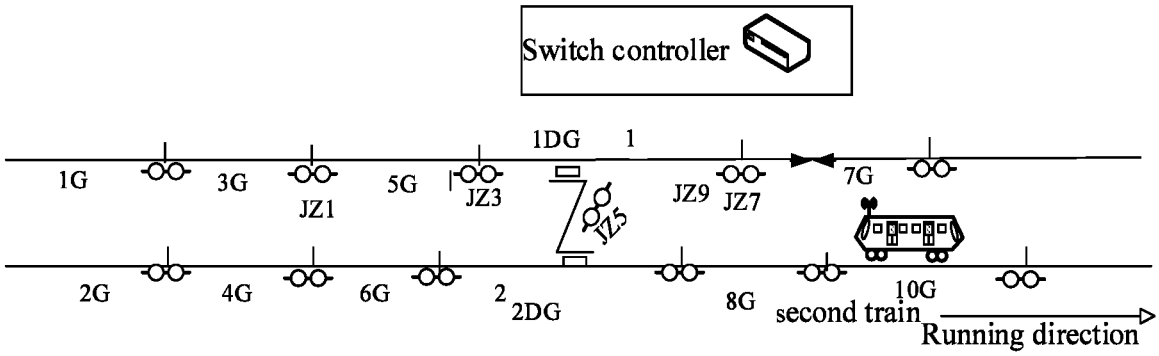
FIG. 7 is a schematic diagram of requesting switch resources by two trains provided by another embodiment of the present invention.

As shown in FIG. 7, after train 1 and train 2 move away from protection section 8G, the shared state of the switch is released. After releasing, the switch is in the released state.

If train 2 is earlier than train 1 in requesting, the switch controller assigns the shared state to train 1. Train 1 can obtain the monopolized state of the switch by requesting and return only after train 2 moves away from protection section 8G and releases the shared state.

Figure 8:
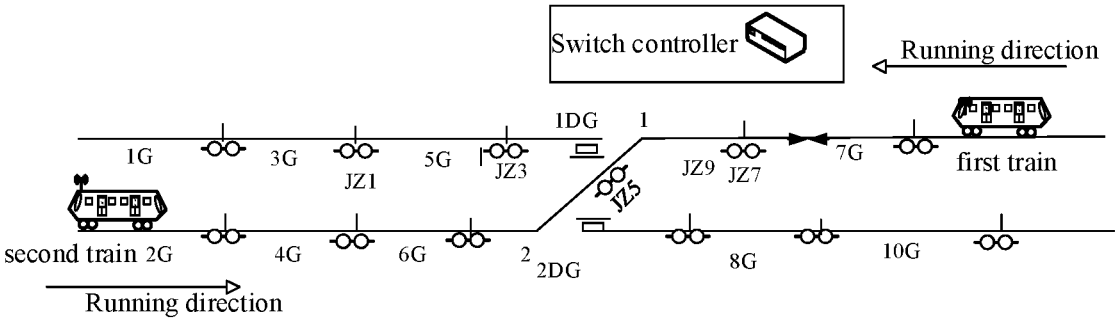
FIG. 8 is a schematic diagram of requesting switch resources by two trains provided by another embodiment of the present invention.

When the control center requests a switch resource for a train out of order, as shown in FIG. 8, train 1 is the train out of order and requires to return, and train 2 is a communication train and requires to pass through the normal position; and train 2 requests for the shared state from the switch controller, and the control center (control center) requests for the monopolized state for train 1. When the switch controller receives request information from the two in different running periods, it performs resource assignment according to the time sequence. When the switch controller receives the request information from the two in the same running period, it assigns the resource to the control center. In FIG. 8, the switch controller assigns the monopolized state to the control center. The control center causes moving of the switch 1/2 to the reverse position for train 1 out of order after holding the monopolized state of the switch, such that train 1 can return.

Figure 9:
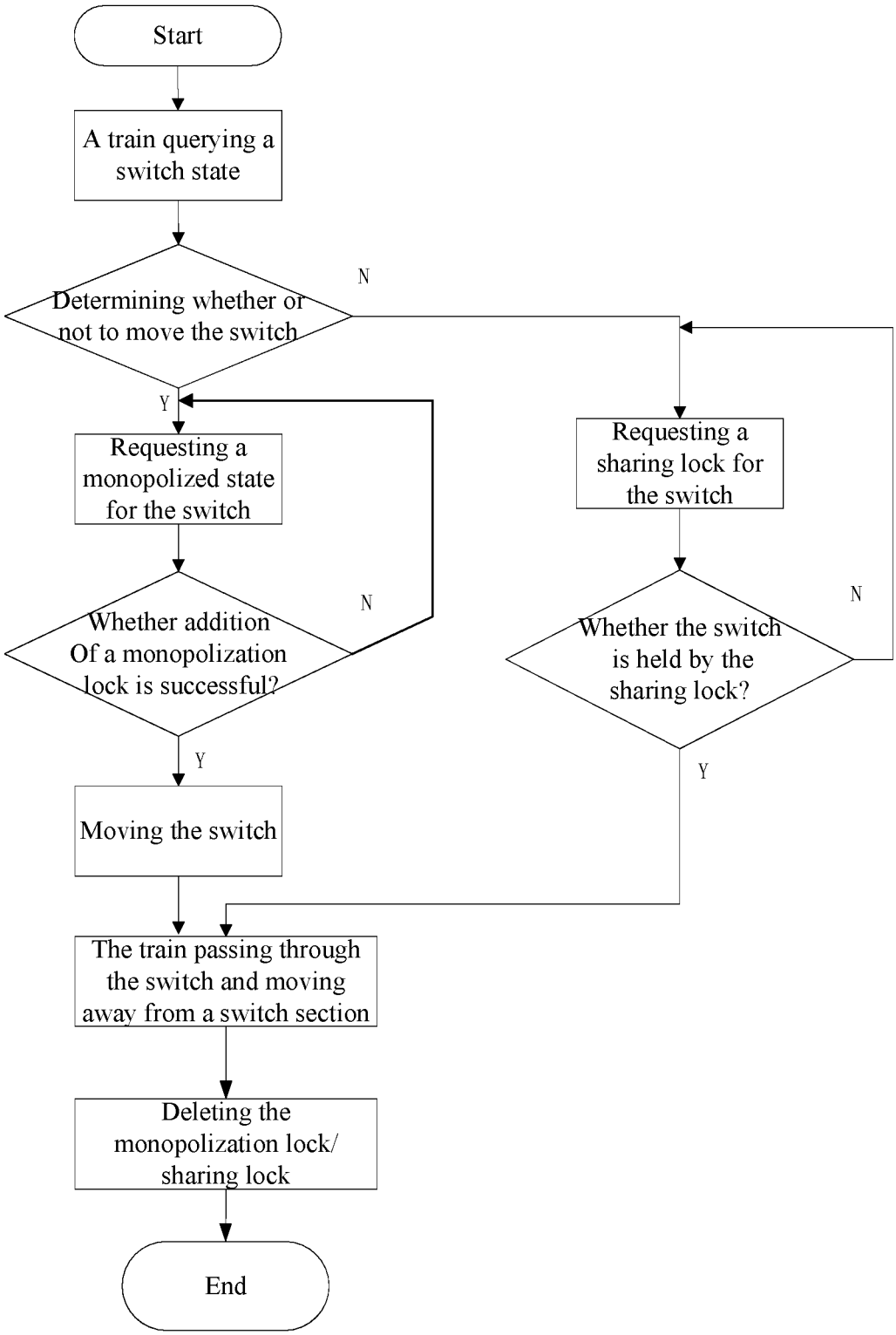
FIG. 9 is a schematic flowchart of request for switch section resources provided by another embodiment of the present invention.

Using a switch section as an example, the flow of resource requesting is as shown in FIG. 9.

Figure 10:
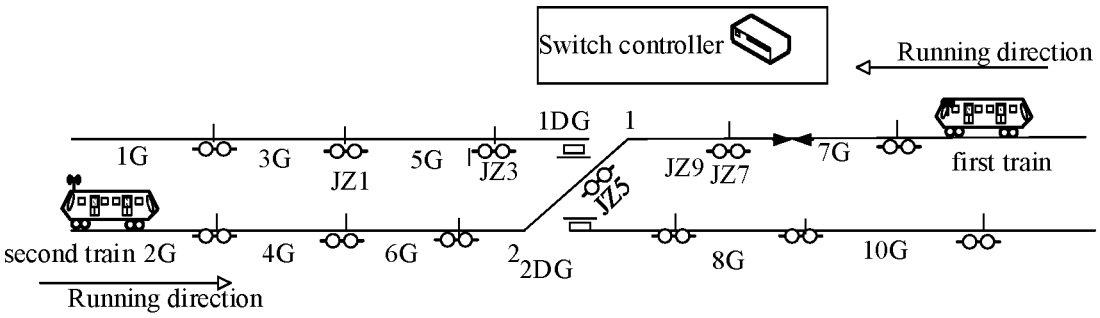
FIG. 10 is a schematic diagram of requesting switch resources by two trains provided by another embodiment of the present invention.

For example, as shown in FIG. 10, train 1 returns, and train 2 passes through the normal position; and train 1 requests for addition of the monopolized state permission on the switch, and train 2 requests for the shared state permission on the switch. The switch controller assigns the switch resource according to the time sequence of request information. If train 1 is earlier than train 2 in requesting, train 1 adds the monopolized state permission on the switch, and train 2 has to enter protection section 6G. Train 1 enters the switch section after moving the switch into the reverse position.

Figure 11:
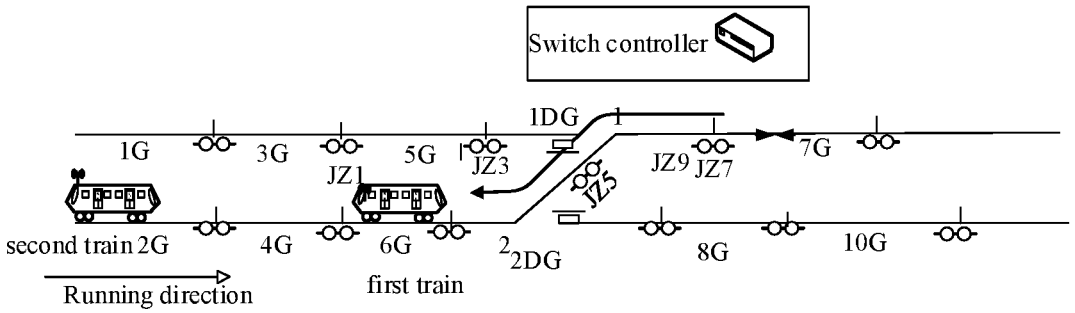
FIG. 11 is a schematic diagram of requesting switch resources by two trains provided by another embodiment of the present invention.

As shown in FIG. 11, after train 1 enters protection section 6G, the switch is moved into the normal position, and the monopolized state permission is deleted. Train 1 and train 2 request for the shared state permission on the switch together.

Figure 12:
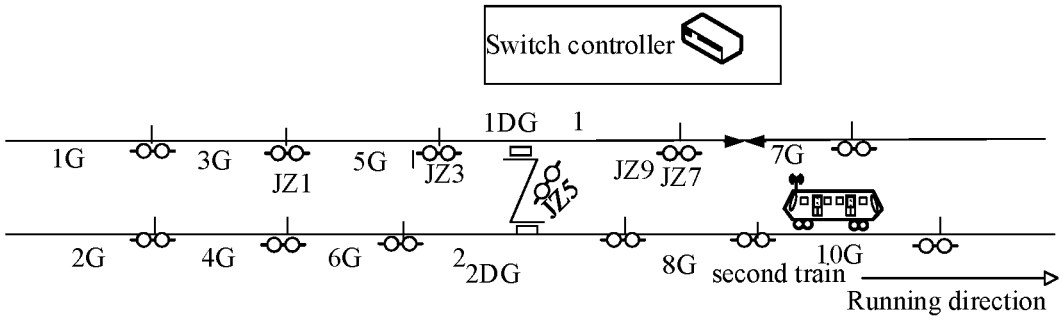
FIG. 12 is a schematic diagram of requesting for switch resources by two trains provided by another embodiment of the present invention.

As shown in FIG. 12, after train 1 and train 2 move away from protection section 8G, the shared state is deleted. After deleting of the shared state permission by both train 1 and train 2, the lock list of the switch is empty. If train 2 is earlier than train 1 in requesting for the lock adding operation, train 2 adds the shared state permission to the switch. Train 1 can add the monopolized state permission to the switch and move the switch to return only after train 2 moves away from protection section 8G and deletes the shared state permission.

Specifically, the assignment solution of switch related resources is as follows: an electronic map is saved in a train, and a switch is associated with the related resources (e.g., protection sections, clearance interfering sections) thereof in the electronic map. A train needs to query about the switch controller before entering a protection section or an intrusion line section. If the train already requests for the monopolized/shared state of the switch or already adds the monopolized/shared state permission to the switch, it can enter the protection section or the intrusion line section; or otherwise, it is not allowed to enter the related sections.

Figure 13:
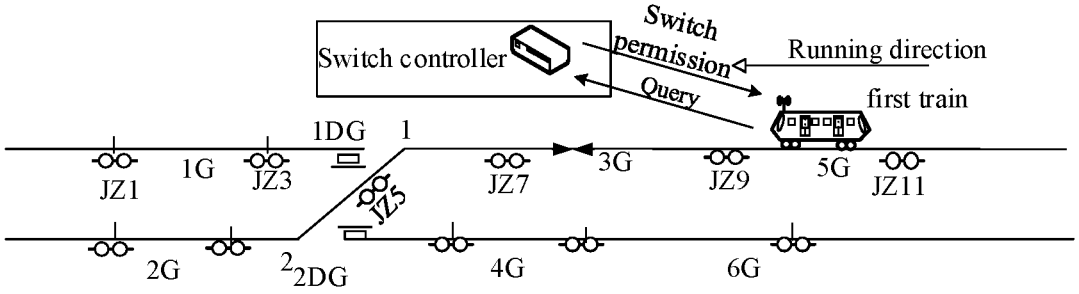
FIG. 13 is a schematic diagram of requesting for switch resources by a train provided by another embodiment of the present invention.

For example, as shown in FIG. 13, train 1 needs to query about the switch controller before entering protection section 3G, and can enter protection section 3G only after requesting for the monopolized/shared state of the switch 1/2 or already adding the monopolized/shared state permission to the switch 1/2.

The switch controller can be arranged at either a train section or a main track, and can be arranged beside a rail or in a station.

After the management zones of the switch controllers are provided, one switch controller is arranged in each management zone. All the sections and switches within one management zone are managed by one switch controller.

Figure 14:
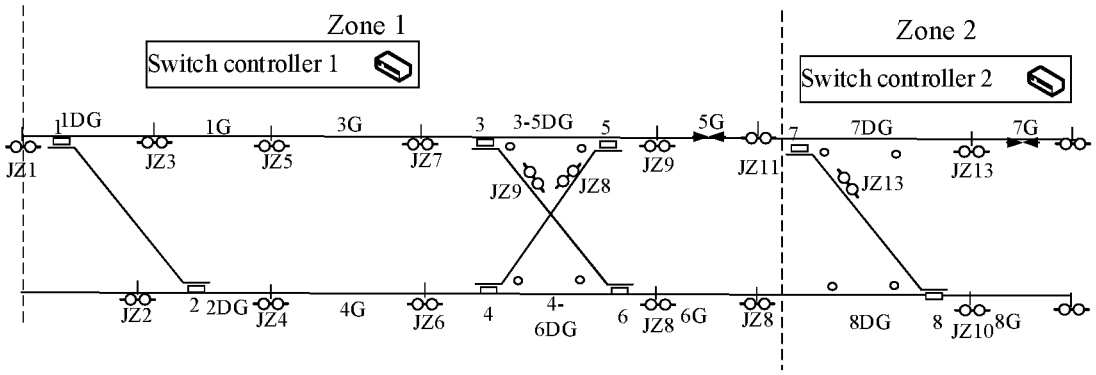
FIG. 14 is a schematic diagram of arrangement of switch controllers provided by another embodiment of the present invention.

As shown in FIG. 14, switch controller 1 manages switch 1/2, switch 3/6 and switch 4/5.

Figure 15:
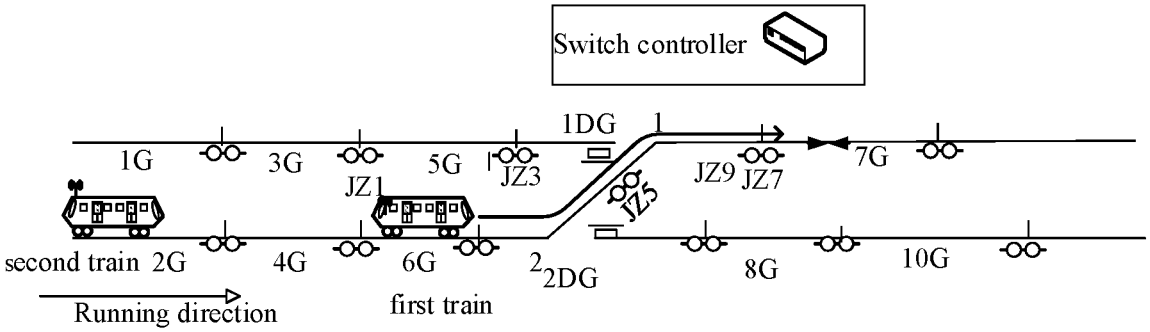
FIG. 15 is a schematic diagram of requesting switch resources by two trains provided by another embodiment of the present invention.

For example, as shown in FIG. 15, if train 1 and train 2 have an identical requirement for the state of a switch, train 1 does not return, then train 1 and train 2 may request together for the shared state of or the shared state permission on switch 1/2. If train 1 communicates with train 2, the two trains may always keep tracking running within the same section and pass through a switch section. In this way, the efficiency of trains passing through a switch zone is greatly improved.

Further, on the basis of the above method embodiments, the method further includes:

Section permission assignment is performed for a switch section corresponding to the switch according to the resource state and the target resource permission.

The train corresponding to the on-board device is controlled according to the result of the section permission assignment.

This embodiments provide a switch control method which can monitor, assign and manipulate line resources, in particular switch and section resources; Interlocking equipment on the ground is cancelled, such that the control of the switch and signal machine changes from centralized to decentralized by the switch controller and the on-board device of a train; In addition, the safety and efficiency of running of a train in a line are guaranteed by means of the mechanism and strategy of managing the monopolized state permission and the shared state permission on line resources by the switch controller instead of using route control.

Further, on the basis of the above method embodiments, the obtaining of the resource state of the switch further includes:

receiving the resource state of the switch sent by a switch machine or an axle counting system in real time.

The resource state of the switch can be known in time by receiving the resource state of the switch sent by the switch machine or the axle counting system in real time.

Figure 16:
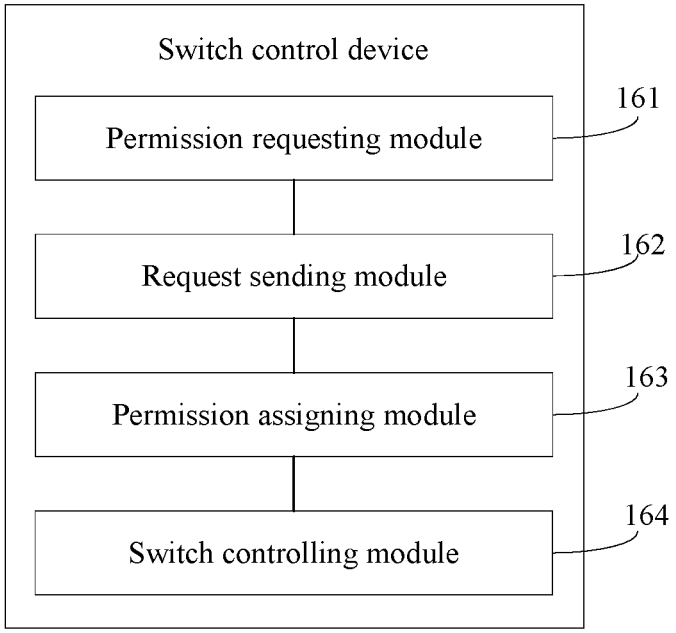
FIG. 16 is a structural schematic diagram of a switch control device provided by an embodiment of the present invention.

FIG. 16 shows a structural schematic diagram of a switch control device provided by present embodiment. The device includes a permission requesting module 161, a request sending module 162, a permission assigning module 163 and a switch controlling module 164, wherein:

the permission requesting module 161 is used for acquiring the switch state and determining the target resource permission to be requested according to the switch state;

the request sending module 162 is used for sending a first resource request to a switch by the on-board device, and the first resource request includes the target resource permission;

the permission assigning module 163 is used for acquiring the resource state of the switch, and assigning a resource permission on the switch according to the resource state and the target resource permission; and the switch controlling module 164 is used for controlling the switch according to the result of the resource permission assignment.

Specifically, the permission requesting module 161 acquires the switch state and determines the target resource permission to be requested according to the switch state; the request sending module 162 sends the first resource request including the target resource permission to the switch; the permission assigning module 163 acquires the resource state of the switch, and assigns the resource permission on the switch according to the resource state and the target resource permission; and the switch controlling module 164 controls the switch according to the result of the resource permission assignment.

The traditional interlocking technique is not used in this embodiment, and such ground equipment as interlocking and signal machines thus do not need to be disposed on the ground, leading to simplification of the control logic and reduction of the equipment cost and the maintenance cost. In addition, depending on the resource request from the on-board device, the resource permission assignment and control of the switch are achieved by determining the resource state of the switch. Before a train arrives at the required switch and section resources, the resources are requested and assigned, thus allowing safety protection on the train and an increase in the utilization rate of line resources.

Further, on the basis of the above device embodiment, the permission requesting module 161 further includes:

a monopolized state requesting unit for determining the target resource permission to be requested as a monopolized state permission if the switch state needs to be changed to accomplish train running; and a shared state requesting unit for determining the target resource permission to be requested as a shared state permission if train running can be accomplished without changing the switch state;

wherein the switch state includes a normal position and a reverse position, and the target resource permission includes the monopolized state permission and the shared state permission.

Further, on the basis of the above device embodiment, the permission assigning module 163 further includes:

a first assigning unit for assigning the monopolized state permission on the switch corresponding to the first resource request to the on-board device if the target resource permission is the monopolized state permission and the switch is in a released state;

a second assigning unit for assigning the shared state permission on the switch corresponding to the first resource request to the on-board device if the target resource permission is the shared state permission and the switch is in the released state;

a third assigning unit for not assigning the resource of the switch corresponding to the first resource request to the on-board device if the target resource permission is the monopolized state permission and the switch is in a monopolized state;

a fourth assigning unit for not assigning the resource of the switch corresponding to the first resource request to the on-board device if the target resource permission is the shared state permission and the switch is in the monopolized state;

a fifth assigning unit for not assigning the resource of the switch corresponding to the first resource request to the on-board device if the target resource permission is the monopolized state permission and the switch is in a shared state; and a sixth assigning unit for assigning the shared state permission on the switch corresponding to the first resource request to the on-board device if the target resource permission is the shared state permission and the switch is in the shared state;

wherein the resource state of the switch includes the monopolized state, the shared state and the released state.

Further, on the basis of the above device embodiment, the switch controlling module 164 further includes:

a switch moving unit for moving the switch if the resource permission obtained by the on-board device is the monopolized state permission on the switch; and a state changing unit for allowing the on-board device to send a resource release request to the switch so as to control the switch to be shifted into the released state after a train passes the switch and moves away from a switch section.

Further, on the basis of the above device embodiment, the switch controlling module 164 is further used for moving the switch if the resource permission obtained by the on-board device is the monopolized state permission on the switch, and then the on-board device sends a resource shifting request to the switch so as to control the switch to be shifted into the released state from the monopolized state after a train passes the switch and moves away from the switch section.

Further, on the basis of the above device embodiment, the device also includes:

a state determining module for determining the resource state of the switch if the first resource request for the switch sent by the on-board device and a second resource request for the switch sent by a control center are received within a predetermined period;

a state changing module for changing the resource state of the switch into the released state if finding, by determination, that a resource permission corresponding to the second resource request is the monopolized state permission and the resource state of the switch is the monopolized state or the shared state; and a resource assigning module for assigning the resource permission corresponding to the second resource request to the control center.

Further, on the basis of the above device embodiment, the device also includes:

an information sending module for receiving a query request sent by the on-board device or the control center, and sending corresponding data information to the on-board device or the control center according to the query request;

an information updating module for sending updated data information to the control center and on-board devices in a train communication list if finding, by determination, that the data information in a switch controller is updated; and a connection interrupting module for interrupting the connection with the on-board device and deleting the on-board device from the train communication list if no query request is received from the on-board device within predetermined time.

The switch control device described in this embodiment can be used for executing the above method embodiments with similar principles and technical effects, which are not redundantly described herein.

Figure 17:
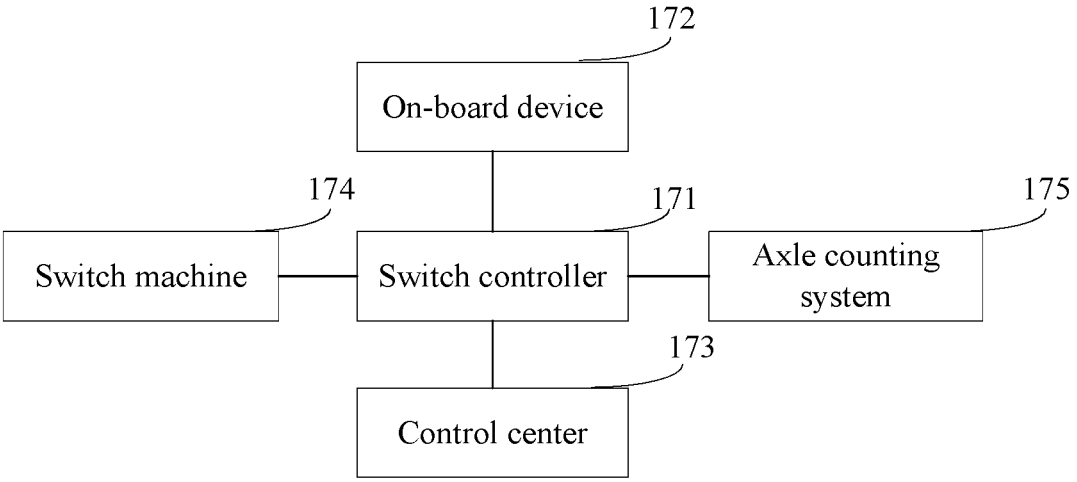
FIG. 17 is a schematic diagram of connection of a switch controller provided by an embodiment of the present invention.

FIG. 17 shows a schematic diagram of connection of a switch controller provided by this embodiment. The switch controller includes the switch control device as described above; the switch controller 171 is connected to the on-board device 172, the control center 173, the switch machine 174 and an axle counting system 175, respectively; the switch controller 171 is arranged beside a rail or in a station.

Specifically, the switch controller is flexible in arrangement, can be arranged beside a rail or in a station. The switch controller may interact with other equipment by accessing a DCS backbone network without wiring. Switch controllers in different zones are identical in logical structure. The switch controllers do not need to save an electromagnetic map, provide remote and local configuration tools, only need to arrange the line resources and equipment ID under management of each switch controller, with good regionality.

This embodiment does not require arrangement of interlocking equipment on the ground and does not use the traditional interlocking technique, and such ground equipment as interlocking and signal machines thus do not need to be disposed on the ground, leading to simplification of the control logic and reduction of the equipment cost and the maintenance cost. The on-board device communicates with the switch controller, and requests for desired switch and section resources before a train arrives at the required switch and section resources, thereby allowing safety protection for the train. In addition, during running, the train can request for line resources to run towards any place. During running of the train, in case of a change in a running plan, a running route can be changed anytime by means of changing of resource requests. The control center manages line resources by means of commands to the switch controller and achieves commanding and dispatching on trains.

The device embodiments described above are just schematic, in which the units illustrated as separate parts can be or not be physically separated; parts shown as units can be or not be physical units, i.e., can be located at one place, or alternatively can be distributed to a plurality of network units. Part of or all the modules therein can be selected according to actual requirements to achieve the objectives of the solutions in the embodiments. These device embodiments will be understood and implemented by a person of ordinary skill in the art without creative work.

From the foregoing descriptions on the implementations, it can be clear for a person skilled in the art that the implementations can be achieved by means of software in conjunction with a necessary general-purpose hardware platform, and certainly can also be achieved by means of hardware. Based on such understanding, the above technical solutions in nature or the part making contributions to the prior art can be embodied in the form of a software product; the computer software product may be stored in a computer readable storage medium, such as an ROM/RAM, a magnetic disk, optical disk or the like, and includes a plurality of instructions for causing a computer device (which can be a personal computer, a server, a network device or the like) to execute the method described in the embodiments or some parts of the embodiments.

It should be noted that the above embodiments are merely intended for illustrating, rather than limiting, the technical solutions of the present invention. Although the present invention is described in detail with reference to the foregoing embodiments, it will be appreciated by a person of ordinary skill in the art that modifications can still be made to the technical solutions described in the foregoing embodiments, or equivalent substitutions can be provided for part of the technical features therein. These modifications or substitutions will not cause the corresponding technical solutions to depart in nature from the spirit and scope of the technical solutions in the embodiments of the present invention.

The invention claimed is:

1. A switch control method, comprising:

an on-board device acquiring a switch state and determining a target resource permission to be requested according to the switch state;

the on-board device sending a first resource request including the target resource permission to a switch;

obtaining a resource state of the switch, and assigning a resource permission on the switch according to the resource state and the target resource permission; and controlling the switch according to a result of resource permission assignment, wherein the determining of the target resource permission to be requested according to the switch state further comprises:

determining the target resource permission to be requested is a monopolized state permission if the switch state needs to be changed to accomplish train running;

determining the target resource permission to be requested is a shared state permission if train running can be accomplished without changing the switch state, wherein the switch state includes a normal position and a reverse position, and the target resource permission includes the monopolized state permission and the shared state permission, wherein the assigning of the resource permission on the switch according to the resource state and the target resource permission further comprises:

assigning the monopolized state permission on the switch corresponding to the first resource request to the on-board device if the target resource permission is the monopolized state permission and the switch is in a released state;

assigning the shared state permission on the switch corresponding to the first resource request to the on-board device if the target resource permission is the shared state permission and the switch is in the released state;

failing to assign the resource of the switch corresponding to the first resource request to the on-board device if the target resource permission is the monopolized state permission and the switch is in a monopolized state;

failing to assign the resource of the switch corresponding to the first resource request to the on-board device if the target resource permission is the shared state permission and the switch is in the monopolized state;

failing to assign the resource of the switch corresponding to the first resource request to the on-board device if the target resource permission is the monopolized state permission and the switch is in a shared state;

assigning the shared state permission on the switch corresponding to the first resource request to the on-board device if the target resource permission is the shared state permission and the switch is in the shared state, wherein the resource states of the switch includes the monopolized state, the shared state and the released state.

2. The method according to claim 1, wherein the controlling the switch according to the result of the resource permission assignment further comprises:

moving the switch if the resource permission acquired by the on-board device is the monopolized state permission on the switch, and the on-board device sending a resource shifting request to the switch so as to control the switch to be shifted into the released state from the monopolized state after a train passes through the switch and moves away from the switch section.

3. The method according to claim 1, further comprising:

determining the resource state of the switch if the first resource request for the switch sent by the on-board device and a second resource request for the switch sent by a control center are received within a predetermined period;

changing the resource state of the switch into the released state if finding, by determination, that a resource permission corresponding to the second resource request is the monopolized state permission and the resource state of the switch is the monopolized state or the shared state;

assigning the resource permission corresponding to the second resource request to the control center.

4. The method according to claim 3, further comprising:

receiving a query request sent by the on-board device or the control center, and sending corresponding data information to the on-board device or the control center according to the query request;

sending updated data information to the control center and on-board devices in a train communication list if finding, by determination, that the data information in a switch controller is updated;

interrupting connection with the on-board device and deleting the on-board device from the train communication list if no query request is received from the on-board device within predetermined time.

5. The method according to claim 1, wherein the controlling the switch according to the result of the resource permission assignment further comprises:

moving the switch if the resource permission acquired by the on-board device is the monopolized state permission on the switch;

the on-board device sending a resource release request to the switch so as to control the switch to be shifted into the released state after a train passes through the switch and moves away from a switch section.

6. A switch control device, comprising:

a processor; and a memory configured to store instructions executable by the processor, wherein the processor is configured to:

acquire a switch state and determine a target resource permission to be requested according to the switch state;

send a first resource request including the target resource permission to a switch;

acquire a resource state of the switch, and assign a resource permission on the switch according to the resource state and the target resource permission;

control the switch according to a result of resource permission assignment, wherein the processor is configured to determine the target resource permission to be requested according to the switch state by:

determining the target resource permission to be requested as a monopolized state permission if the switch state needs to be changed to accomplish train running;

determining the target resource permission to be requested as a shared state permission if train running can be accomplished without changing the switch state, wherein the switch state includes a normal position and a reverse position, and the target resource permission includes the monopolized state permission and the shared state permission, wherein the processor is configured to assign the resource permission on the switch according to the resource state and the target resource permission by:

assigning the monopolized state permission on the switch corresponding to the first resource request to the on-board device if the target resource permission is the monopolized state permission and the switch is in a released state;

assigning the shared state permission on the switch corresponding to the first resource request to the on-board device if the target resource permission is the shared state permission and the switch is in the released state;

failing to assign the resource of the switch corresponding to the first resource request to the on-board device if the target resource permission is the monopolized state permission and the switch is in a monopolized state;

failing to assign the resource of the switch corresponding to the first resource request to the on-board device if the target resource permission is the shared state permission and the switch is in the monopolized state;

failing to assign the resource of the switch corresponding to the first resource request to the on-board device if the target resource permission is the monopolized state permission and the switch is in a shared state;

assigning the shared state permission on the switch corresponding to the first resource request to the on-board device if the target resource permission is the shared state permission and the switch is in the shared state, wherein the resource states of the switch includes the monopolized state, the shared state and the released state.

7. A switch controller, comprising the switch control device of claim 6, wherein the switch controller is connected to an on-board device, a control center, a switch machine and an axle counting system, respectively; and the switch controller is arranged beside a rail or in a station.

* * * * *